US011149588B2

(12) United States Patent
Kuwamura

(10) Patent No.: US 11,149,588 B2
(45) Date of Patent: Oct. 19, 2021

(54) EXHAUST CHAMBER OF STEAM TURBINE, FLOW GUIDE FOR STEAM TURBINE EXHAUST CHAMBER, AND STEAM TURBINE

(71) Applicant: MITSUBISHI HEAVY INDUSTRIES, LTD., Tokyo (JP)

(72) Inventor: Yoshihiro Kuwamura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 382 days.

(21) Appl. No.: 16/326,422

(22) PCT Filed: Oct. 31, 2017

(86) PCT No.: PCT/JP2017/039244
§ 371 (c)(1),
(2) Date: Apr. 29, 2019

(87) PCT Pub. No.: WO2018/079805
PCT Pub. Date: May 3, 2018

(65) Prior Publication Data

US 2021/0285338 A1 Sep. 16, 2021

(30) Foreign Application Priority Data

Oct. 31, 2016 (JP) ..... JP2016-212491

(51) Int. Cl.
*F01D 25/24* (2006.01)
*F01D 25/30* (2006.01)

(52) U.S. Cl.
CPC ..... *F01D 25/24* (2013.01); *F05D 2220/31* (2013.01)

(58) Field of Classification Search
CPC ..... F01D 25/24; F01D 25/30; F05D 2220/31; F05D 2250/70
See application file for complete search history.

(56) References Cited

U.S. PATENT DOCUMENTS 3,631,672 A * 1/1972 Gentile ..... F02C 7/18 415/116
3,690,786 A * 9/1972 Silvestri, Jr. ..... F01D 25/30 415/169.4

(Continued)

FOREIGN PATENT DOCUMENTS

CH 362093 5/1962
JP 06-066157 3/1994

(Continued)

OTHER PUBLICATIONS

International Search Report dated Jan. 16, 2018 in International (PCT) Application No. PCT/JP2017/039244 with English translation.

(Continued)

*Primary Examiner* — Igor Kershteyn
(74) *Attorney, Agent, or Firm* — Wenderoth, Lind & Ponack, L.L.P.

(57) ABSTRACT

An exhaust chamber of a steam turbine includes a casing, an inner flow guide portion disposed in the casing so as to define an outer boundary of a diffuser passage communicating with an outlet of a last stage blade in the steam turbine, and an outer flow guide portion disposed on an outer peripheral side of the inner flow guide portion in the casing. The exhaust chamber has an exhaust chamber outlet on a lower side thereof. The outer flow guide portion is disposed at least around an upper half region of the inner flow guide portion.

14 Claims, 8 Drawing Sheets

(56) References Cited

U.S. PATENT DOCUMENTS

| | | | | |
|---|---|---|---|---|
| 4,315,715 | A * | 2/1982 | Nishiguchi | F04D 29/441 415/207 |
| 5,257,906 | A | 11/1993 | Gray et al. | |
| 5,340,276 | A * | 8/1994 | Norris | F01D 25/30 415/208.1 |
| 2009/0068006 | A1* | 3/2009 | Hardin | F01D 25/30 415/211.2 |
| 2011/0158799 | A1* | 6/2011 | Dalsania | F01D 25/30 415/211.2 |
| 2012/0163969 | A1* | 6/2012 | Ongole | F01D 25/30 415/210.1 |
| 2015/0167468 | A1 | 6/2015 | Bison et al. | |
| 2019/0353053 | A1* | 11/2019 | Kuwamura | F01D 25/24 |
| 2020/0173309 | A1* | 6/2020 | Sugishita | F01D 25/30 |

FOREIGN PATENT DOCUMENTS

| | | |
|---|---|---|
| JP | 10-227202 | 8/1998 |
| JP | 11-200814 | 7/1999 |
| JP | 2003-027905 | 1/2003 |
| JP | 2004-150357 | 5/2004 |
| JP | 2011-220125 | 11/2011 |
| JP | 2012-132455 | 7/2012 |
| JP | 2015-523496 | 8/2015 |

OTHER PUBLICATIONS

International Preliminary Report on Patentability dated May 9, 2019 in International (PCT) Application No. PCT/JP2017/039244 with English translation.

* cited by examiner

EXHAUST CHAMBER OF STEAM TURBINE, FLOW GUIDE FOR STEAM TURBINE EXHAUST CHAMBER, AND STEAM TURBINE

TECHNICAL FIELD

The present disclosure relates to an exhaust chamber of a steam turbine, a flow guide for a steam turbine exhaust chamber, and a steam turbine.

BACKGROUND

Steam from a turbine casing of a steam turbine is normally discharged from the steam turbine via an exhaust chamber. In the exhaust chamber, a fluid loss is caused by characteristics of a steam flow, a shape of an internal, or the like. Therefore, a configuration for reducing the fluid loss in the exhaust chamber is proposed.

For example, Patent Document 1 discloses a steam turbine. The steam turbine applies swirl to a tip flow in a diffuser flow passage of an exhaust chamber by disposing a deflection member on a flow guide forming the diffuser flow passage, and then reduces a loss when the tip flow and a steam main flow are mixed.

In addition, Patent Document 2 discloses a steam turbine which has an exhaust chamber defined by an outer turbine casing and an inner turbine casing of a turbine, and is provided with a rectifier unit on a lower side of a lower half part of the inner turbine casing. Thus, the steam turbine prevents a steam flow toward an outlet below the exhaust chamber from separating on a lower side of the inner turbine casing.

CITATION LIST

Patent Literature

Patent Document 1: JP2011-220125A
Patent Document 2: JP2003-27905A

SUMMARY

Technical Problem

The steam turbines disclosed in Patent Document 1 and Patent Document 2 are expected to reduce the loss in the exhaust chamber by the deflection member and the rectifier unit disposed in the exhaust chamber.

However, a further measure to reduce the fluid loss in the exhaust chamber of the steam turbine is desired.

In view of the above, an object of at least one embodiment of the present invention is to provide an exhaust chamber of a steam turbine, a flow guide for a steam turbine exhaust chamber, and a steam turbine which can reduce the fluid loss in the exhaust chamber.

Solution to Problem (1) An exhaust chamber of a steam turbine according to at least one embodiment of the present invention includes a casing, an inner flow guide portion disposed in the casing so as to define an outer boundary of a diffuser passage communicating with an outlet of a last stage blade in the steam turbine, and an outer flow guide portion disposed on an outer peripheral side of the inner flow guide portion in the casing. The exhaust chamber has an exhaust chamber outlet on a lower side thereof. The outer flow guide portion is disposed at least around an upper half region of the inner flow guide portion.

A steam flow passing through the diffuser passage may form separation vortices on a back side of the inner flow guide portion (an opposite side to the diffuser passage across the inner flow guide portion) forming the diffuser passage. In this regard, with the above configuration (1), since the outer flow guide portion is disposed at least around the upper half region of the inner flow guide portion, the outer flow guide portion guides a steam flow passing through the diffuser passage and tending to circulate back into the upper half region of the inner flow guide portion. Thus, it is possible to reduce the separation vortices of the steam flow. Thus, it is possible to reduce a fluid loss in the exhaust chamber and to improve efficiency in the steam turbine as a whole.

(2) In some embodiments, in the above configuration (1), at least a part of a connection portion between the outer flow guide portion and the upper half region of the inner flow guide portion has a curved shape in a cross section along an axial direction of the inner flow guide portion.

With the above configuration (2), since the steam flow tending to circulate back into the upper half region of the inner flow guide portion flows to the outer flow guide portion via the connection portion having the curved shape, it is possible to reduce the separation vortices of the steam flow even further. Thus, it is possible to reduce a fluid loss in the exhaust chamber more effectively.

(3) In some embodiments, in the above configuration (1) or (2), the outer flow guide portion is disposed on an outer peripheral side of the inner flow guide portion over an entire periphery of the inner flow guide portion.

With the above configuration (3), since the outer flow guide portion is disposed on the entire periphery of the inner flow guide portion, it is possible to suppress even a separation vortex of a steam flow directed downward along the outer flow guide portion after passing through the diffuser passage and circulating back into the upper half region of the inner flow guide portion.

(4) In some embodiments, in the above configuration (3), an angular position around a center axis of the inner flow guide portion at which a radial distance between a first intersection point of the inner flow guide portion with a line segment extending radially from the center axis and a second intersection point of the outer flow guide portion with the line segment becomes maximum is included in an angular range on a lower side of a horizontal plane including the center axis.

Since the above-described exhaust chamber has the exhaust chamber outlet on the lower side, flows directed downward as a whole are mainly formed in the exhaust chamber. In this regard, with the above configuration (4), since an interval between the inner flow guide portion and the outer flow guide portion (the distance between the first intersection point and the second intersection point) becomes maximum in a lower half region, it is possible to effectively suppress the separation vortices in correspondence with the downward flows in the exhaust chamber.

(5) In some embodiments, in the above configuration (4), the angular position at which the radial distance becomes maximum is located at a downstream side in a swirl direction of a steam flow in an exhaust chamber inlet of the exhaust chamber compared to an angular position extending vertically downward through the center axis.

A flow in the exhaust chamber is influenced by a rotation of a turbine rotor, and thus may include a swirl component.

In this case, flow deflection owing to the swirl component occurs in the exhaust chamber. In this regard, with the above configuration (5), an angular position at which the interval between the inner flow guide portion and the outer flow guide portion (the distance between the first intersection point and the second intersection point) becomes maximum is displaced to the downstream side in the swirl direction, giving the outer flow guide portion a shape considering the flow deflection and making it possible to reduce a pressure loss.

(6) In some embodiments, in any one of the above configurations (3) to (5), the exhaust chamber of the steam turbine further includes an intermediate flow guide portion disposed below the inner flow guide portion so as to suspend from a lower half region of the inner flow guide portion toward a lower half region of the outer flow guide portion, and the intermediate flow guide portion connects the lower half region of the inner flow guide portion and the lower half region of the outer flow guide portion.

With the above configuration (6), the intermediate flow guide portion which connects the lower half region of the inner flow guide portion and the lower half region of the outer flow guide portion appropriately guides a downward flow flowing out of the lower half region of the inner flow guide portion. It is possible to effectively suppress the separation vortices below the inner flow guide portion.

(7) In some embodiments, in the above configuration (6), the intermediate flow guide portion is oblique with respect to a vertical direction to be directed to an upstream side of a steam flow in the diffuser passage toward downward in a cross section along an axial direction of the inner flow guide portion.

With the above configuration (7), a cross-sectional area of the steam flow passage formed by the intermediate flow guide portion is gradually expanded downward, promoting static pressure recovery in the exhaust chamber. Thus, it is possible to reduce a loss in the exhaust chamber more effectively.

(8) In some embodiments, in any one of the above configurations (3) to (7), in a cross section along an orthogonal plane of a center axis of the inner flow guide portion, a lower end part of the outer flow guide portion includes a first discontinuous point on a first surface of the outer flow guide portion facing an inner surface of a first side wall of the casing and a second discontinuous point on a second surface of the outer flow guide portion facing an inner surface of a second side wall of the casing on an opposite side to the first side wall.

With the above configuration (8), at the first discontinuous point and the second discontinuous point of the lower end part of the outer flow guide portion, flows guided by the outer flow guide portion toward downward easily separate from each other, respectively. Therefore, flow separation positions in the lower end part of the outer flow guide portion are fixed (stabilized), making it possible to reduce an unsteady loss.

(9) In some embodiments, in the above configuration (8), the first discontinuous point and the second discontinuous point have different height positions from one another.

With the above configuration (9), since the first discontinuous point and the second discontinuous point are disposed at the different height positions, the flow separation positions in the lower end part of the outer flow guide portion become asymmetric, making it possible to suppress occurrence of an unsteady vortex. Thus, it is possible to reduce the unsteady loss more effectively.

(10) In some embodiments, in any one of the above configurations (1) to (9), an upper half region of the outer flow guide portion is displaced from a center axis of the inner flow guide portion such that a distance between an inner wall surface of the casing and the upper half region of the outer flow guide portion on a downstream side in a swirl direction of a steam flow in an exhaust chamber inlet of the exhaust chamber is larger than the distance between the inner wall surface of the casing and the upper half region of the outer flow guide portion on an upstream side in the swirl direction.

In the exhaust chamber, the steam flow tends to deflect on the downstream side in the swirl direction in the upper half region. In this regard, with the above configuration (10), the upper half region of the outer flow guide portion is displaced from the center axis of the inner flow guide portion such that a flow passage cross-sectional area on the downstream side in the swirl direction of the steam flow increases in the upper half region of the exhaust chamber. Therefore, it is possible to reduce the pressure loss of the fluid in the exhaust chamber and to improve efficiency in the steam turbine as a whole more effectively.

(11) A steam turbine according to at least one embodiment of the present invention includes the exhaust chamber according to any one of the above (1) to (10), a rotor blade disposed on an upstream side of the exhaust chamber, and a stator vane disposed on the upstream side of the exhaust chamber.

With the above configuration (11), since the outer flow guide portion is disposed at least around the upper half region of the inner flow guide portion, the outer flow guide portion guides a steam flow passing through the diffuser passage and tending to circulate back into the upper half region of the inner flow guide portion. Thus, it is possible to reduce the separation vortices of the steam flow. Thus, it is possible to reduce a fluid loss in the exhaust chamber and to improve efficiency in the steam turbine as a whole.

(12) A flow guide for an exhaust chamber of a steam turbine according to at least one embodiment of the present invention includes an inner flow guide portion, and an outer flow guide portion disposed on an outer peripheral side of the inner flow guide portion.

The outer flow guide portion is disposed on the outer peripheral side of the inner flow guide portion over an entire periphery of the inner flow guide portion.

With the above configuration (12), since the outer flow guide portion is disposed over the entire periphery of the inner flow guide portion, the outer flow guide portion guides a steam flow passing through a diffuser passage and tending to circulate back into an upper half region of the inner flow guide portion when the flow guide is applied to the exhaust chamber of the steam turbine. Thus, it is possible to reduce the separation vortices of the steam flow, and to suppress even a separation vortex of a steam flow directed downward along the outer flow guide portion after passing through the diffuser passage and circulating back into the upper half region of the inner flow guide portion. Thus, it is possible to effectively reduce a fluid loss in the exhaust chamber and to improve efficiency in the steam turbine as a whole.

Advantageous Effects

According to at least one embodiment of the present invention, provided are an exhaust chamber of a steam turbine, a flow guide for a steam turbine exhaust chamber, and a steam turbine which can reduce a fluid loss in the exhaust chamber.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

First, an overall configuration of a steam turbine according to some embodiments will be described.

Figure 1:
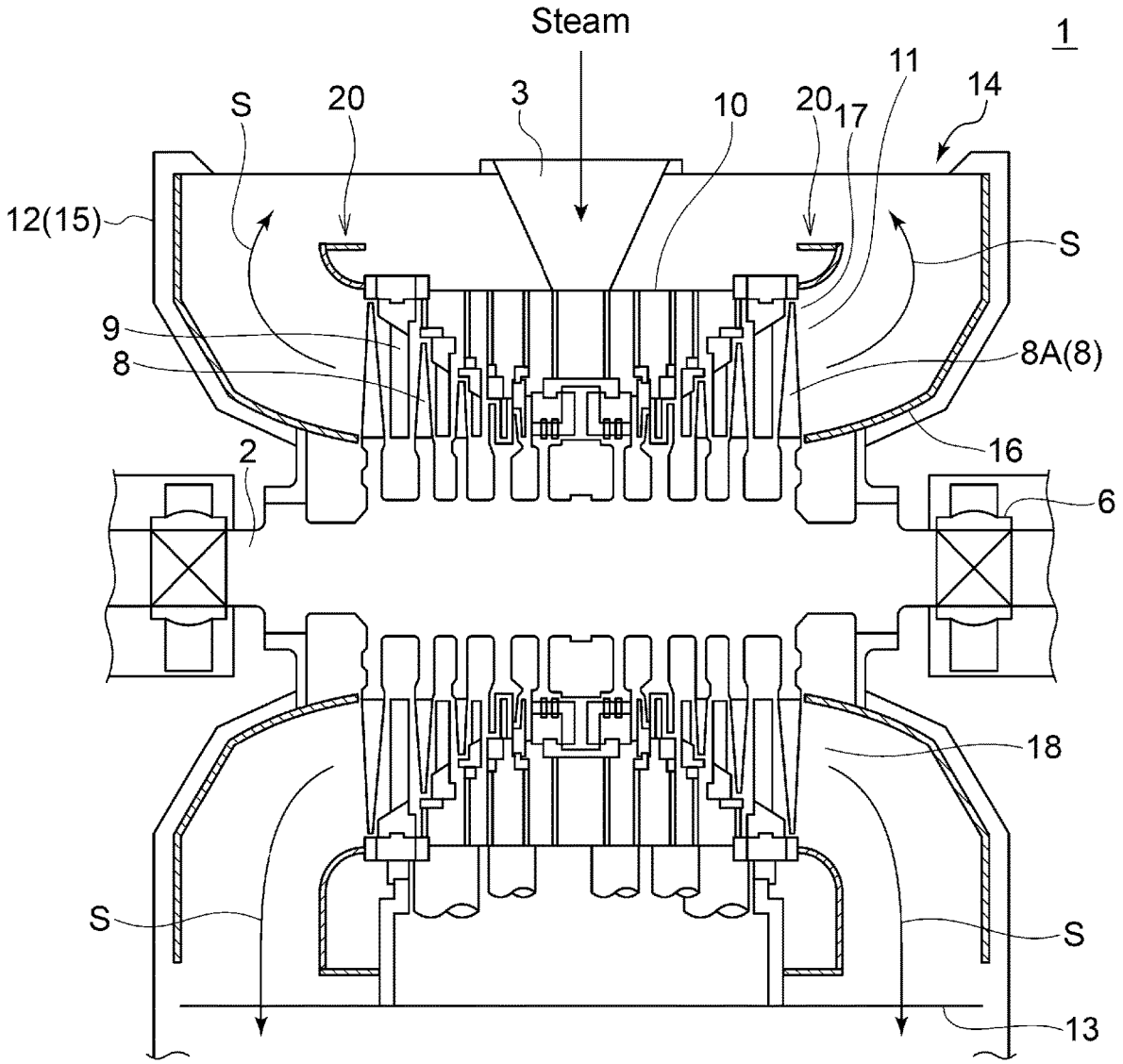
FIG. 1 is a schematic cross-sectional view of a steam turbine according to an embodiment, taken along its axial direction.

FIG. 1 is a schematic cross-sectional view of a steam turbine according to an embodiment, taken along its axial direction. As shown in FIG. 1, a steam turbine 1 includes a rotor 2 rotatably supported by a bearing portion 6, a plurality of stages of rotor blades 8 mounted to the rotor 2, an inner casing 10 accommodating the rotor 2 and the rotor blades 8, and a plurality of stages of stator vanes 9 mounted to the inner casing 10 so as to face the rotor blades 8. In addition, the inner casing 10 is provided with an outer casing 12 on the outside.

In such a steam turbine 1, if steam is introduced from a steam inlet 3 to the inner casing 10, the steam expands and increases in speed when passing through the stator vane 9, performs work on the rotor blades 8, and rotates the rotor 2.

In addition, the steam turbine 1 includes an exhaust chamber 14. The exhaust chamber 14 is positioned on a downstream side of the rotor blades 8 and stator vanes 9. That is, the rotor blades 8 and the stator vanes 9 are disposed on an upstream side of the exhaust chamber 14. Steam having passed through the rotor blades 8 and the stator vanes 9 in the inner casing 10 (steam flows S) flows into the exhaust chamber 14 from an exhaust chamber inlet 11, and is discharged to the outside of the steam turbine 1 from an exhaust chamber outlet 13 disposed on a lower side of the exhaust chamber 14 through the inside of the exhaust chamber 14.

A condenser (not shown) may be disposed below the exhaust chamber 14. The steam having finished performing work on the rotor blades 8 in the steam turbine 1 may flow into the condenser from the exhaust chamber 14 via the exhaust chamber outlet 13.

Next, with reference to FIGS. 1 to 7B, the configuration of the exhaust chamber 14 according to some embodiments will be described in more detail.

FIGS. 2A to 7B are each a schematic cross-sectional view of the exhaust chamber according to an embodiment.

Figure 2B:
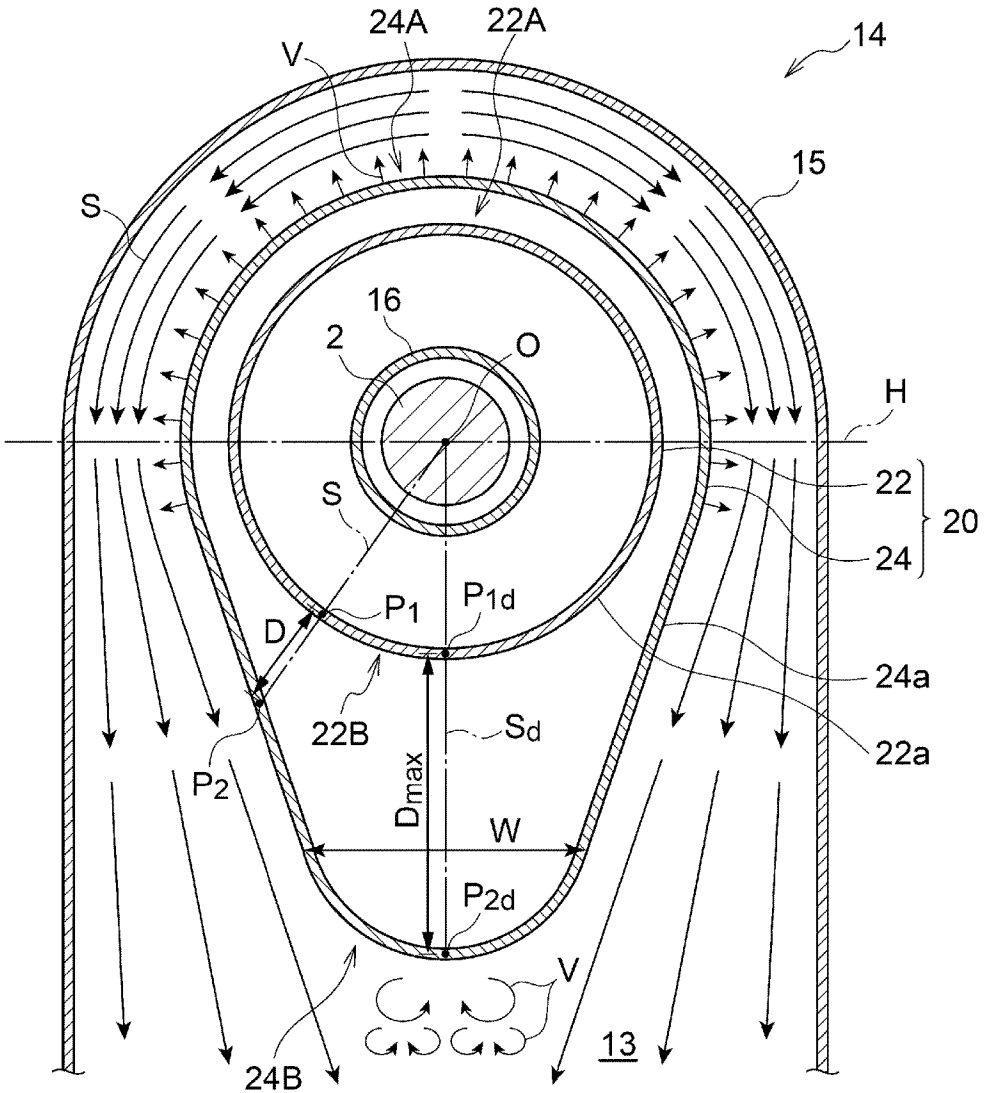
FIG. 2B is a cross-sectional view taken along line B-B of FIG. 2A.
Figure 2A:
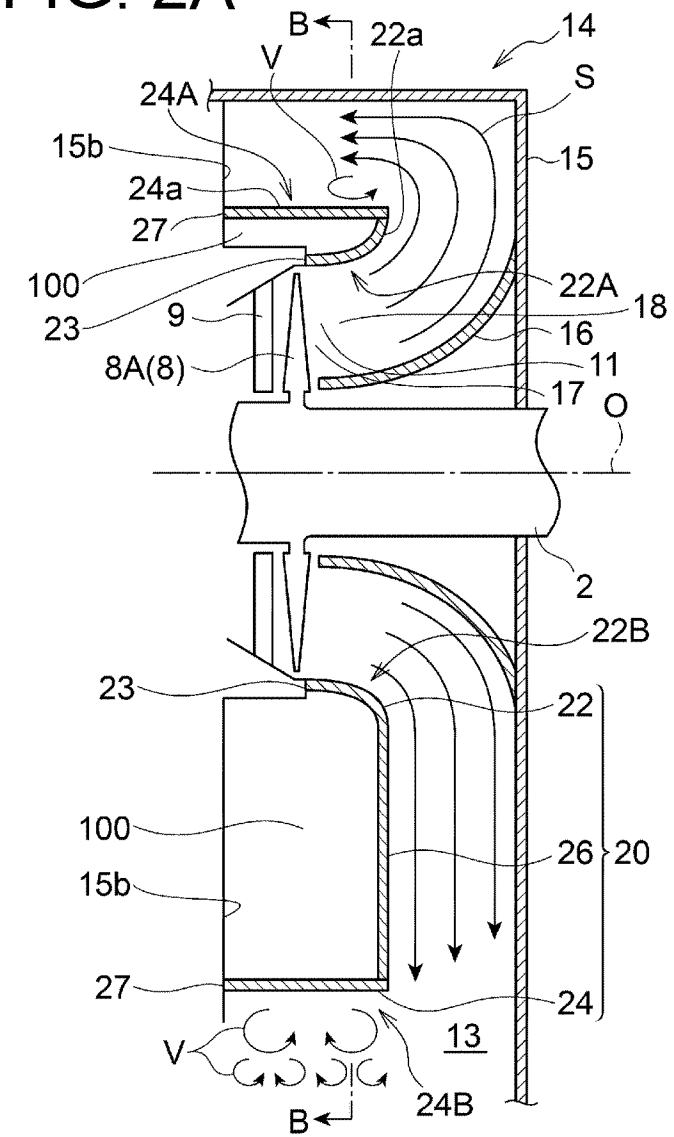
FIG. 2A is a cross-sectional view of an inner flow guide portion of an exhaust chamber according to an embodiment, taken along an axial direction.
Figure 3A:
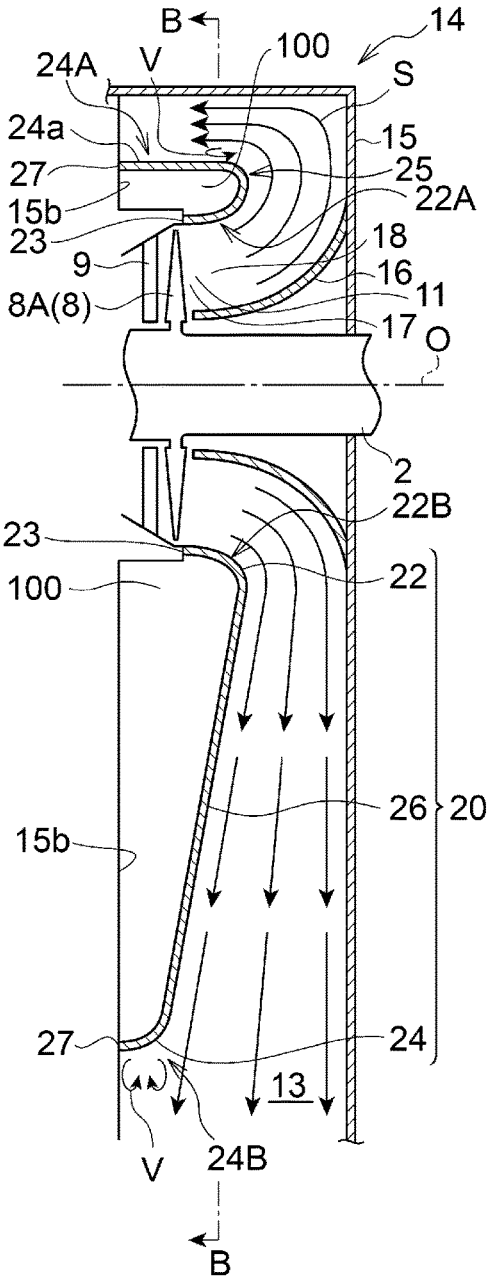
FIG. 3A is a cross-sectional view of the inner flow guide portion of the exhaust chamber according to an embodiment, taken along the axial direction.
Figure 4:
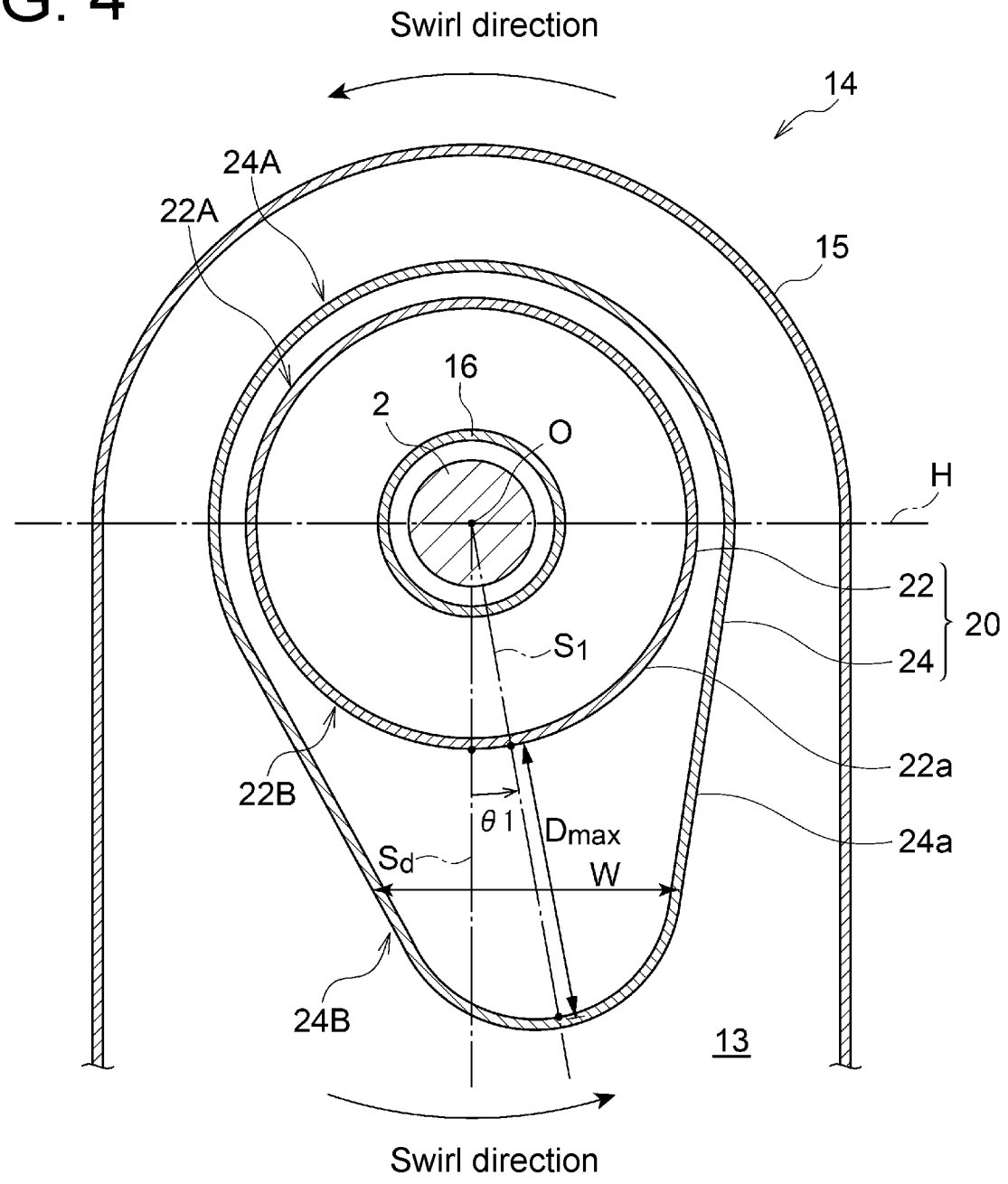
FIG. 4 is a schematic cross-sectional view of the exhaust chamber according to an embodiment.
Figure 5:
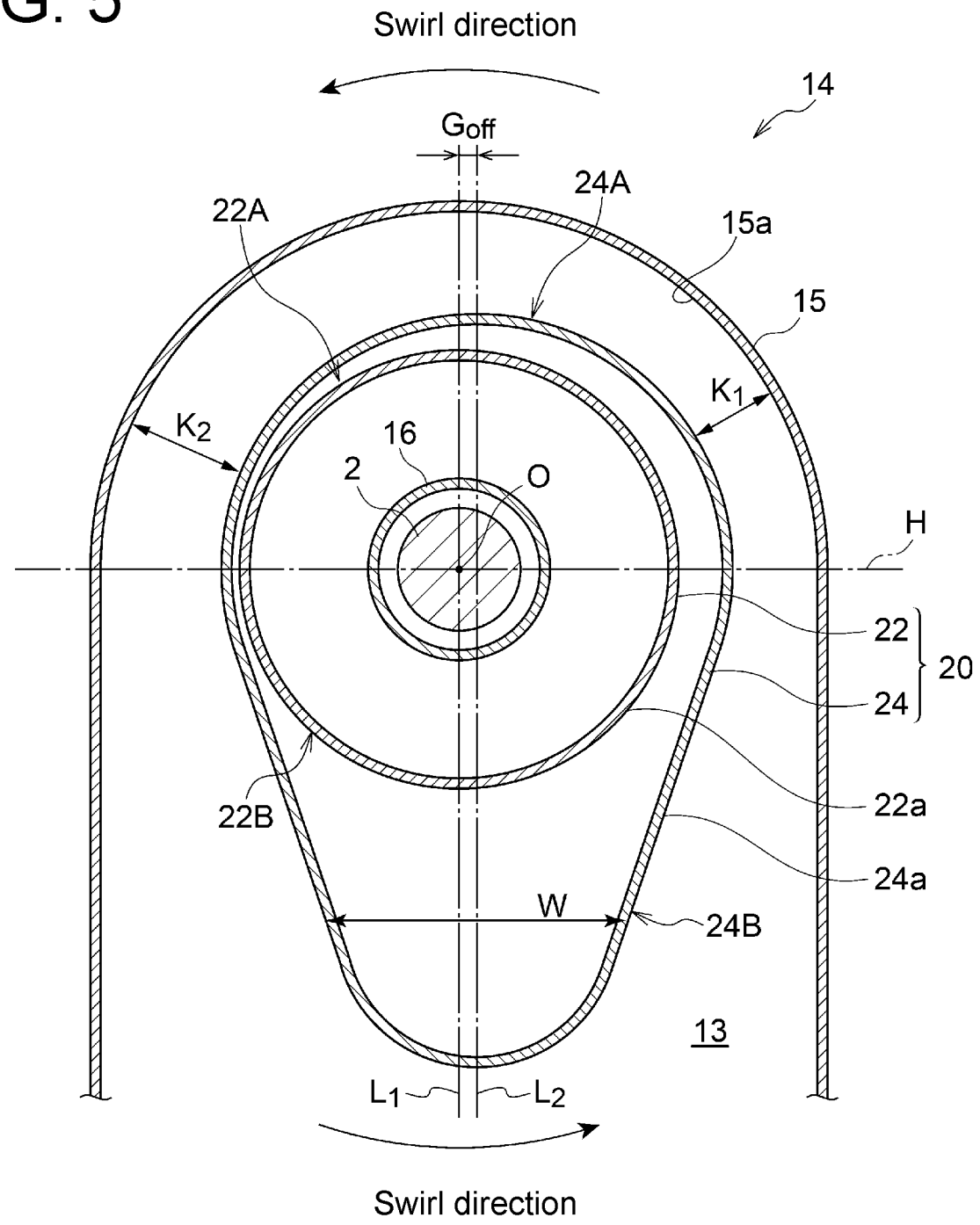
FIG. 5 is a schematic cross-sectional view of the exhaust chamber according to an embodiment.

FIGS. 2A, 3A, 6A, and 7A are each the cross-sectional view of an inner flow guide portion of the exhaust chamber according to an embodiment, taken along an axial direction. FIGS. 2B, 3B, 6B, and 7B are each the cross-sectional view taken along line B-B of a corresponding one of FIGS. 2A, 3A, 6A, and 7A. In addition, FIGS. 4 and 5 are each the cross-sectional view taken along a plane orthogonal to the axial direction of the flow guide portion of the exhaust chamber according to an embodiment, and a view corresponding to the cross-sectional view shown in each of FIGS. 2B, 3B, 6B, and 7B.

As shown in FIG. 1, the exhaust chamber 14 according to some embodiments includes a casing 15, a bearing cone 16 disposed so as to cover the bearing portion 6 in the casing 15, and a flow guide 20 disposed on an outer peripheral side of the bearing cone 16 in the casing 15. That is, the bearing cone 16 is disposed on an inner peripheral side of the flow guide 20 in the casing 15. In addition, a downstream end of the bearing cone 16 is connected to an inner wall surface of the casing 15.

As shown in FIG. 1, the casing 15 of the exhaust chamber 14 may form at least a part of the outer casing 12 of the steam turbine 1.

The exhaust chamber 14 has the exhaust chamber outlet 13 on the lower side. Steam is discharged from the steam turbine 1 via the exhaust chamber outlet 13.

Inside the casing 15, an annular diffuser passage 18 (steam flow passage) is formed by the bearing cone 16 and the flow guide 20.

The diffuser passage 18 communicates with a last stage blade outlet 17 of the steam turbine 1 and has a shape with a gradually increasing cross-sectional area. Then, if the high-speed steam flow S having passed through a last stage rotor blade 8A of the steam turbine 1 flows into the diffuser passage 18 via the last stage blade outlet 17, the steam flow S is decreased in speed, and kinetic energy thereof is converted into a pressure (static pressure recovery).

As shown in FIGS. 2A to 7B, in the exhaust chamber 14 according to some embodiments, the flow guide 20 includes an inner flow guide portion 22 and an outer flow guide portion 24. The inner flow guide portion 22 is disposed in the casing 15 so as to define an outer boundary of the diffuser passage 18. In addition, the outer flow guide portion is disposed on an outer peripheral side of the inner flow guide portion 22 in the casing 15.

The inner flow guide portion 22 is configured to guide the steam flows S by its inner surface 22*a* (a surface forming the diffuser passage 18 by facing the bearing cone 16; see FIGS. 2A and 2B). The outer flow guide portion 24 is configured to guide the steam flows S by its outer surface 24*a* (a surface facing the casing 15; see FIGS. 2A and 2B).

Then, the outer flow guide portion 24 is disposed at least around an upper half region 22A of the inner flow guide portion 22. That is, in the exemplary embodiments shown in FIGS. 2A to 7B, an upper half region 24A of the outer flow guide portion 24 is disposed around the upper half region 22A of the inner flow guide portion 22.

In the present specification, a region on an upper side of a center axis O of the inner flow guide portion 22 is referred to as an upper half region, and a region on a lower side of the center axis O of the inner flow guide portion 22 is referred to as a lower half region. In addition, the upper half region 22A and a lower half region 22B of the inner flow guide portion 22 are portions positioned in the upper half region and the lower half region described above of the inner flow guide portion 22, respectively. The upper half region 24A and a lower half region 24B of the outer flow guide portion 24 are portions positioned in the upper half region and the lower half region described above of the outer flow guide portion 24, respectively.

As shown in FIGS. 2A and 2B, and the like, the center axis O of the inner flow guide portion 22 may exist on the same line as the center axis of the rotor 2, or may exist on the same line as a center axis of the bearing cone 16.

Figure 7B:
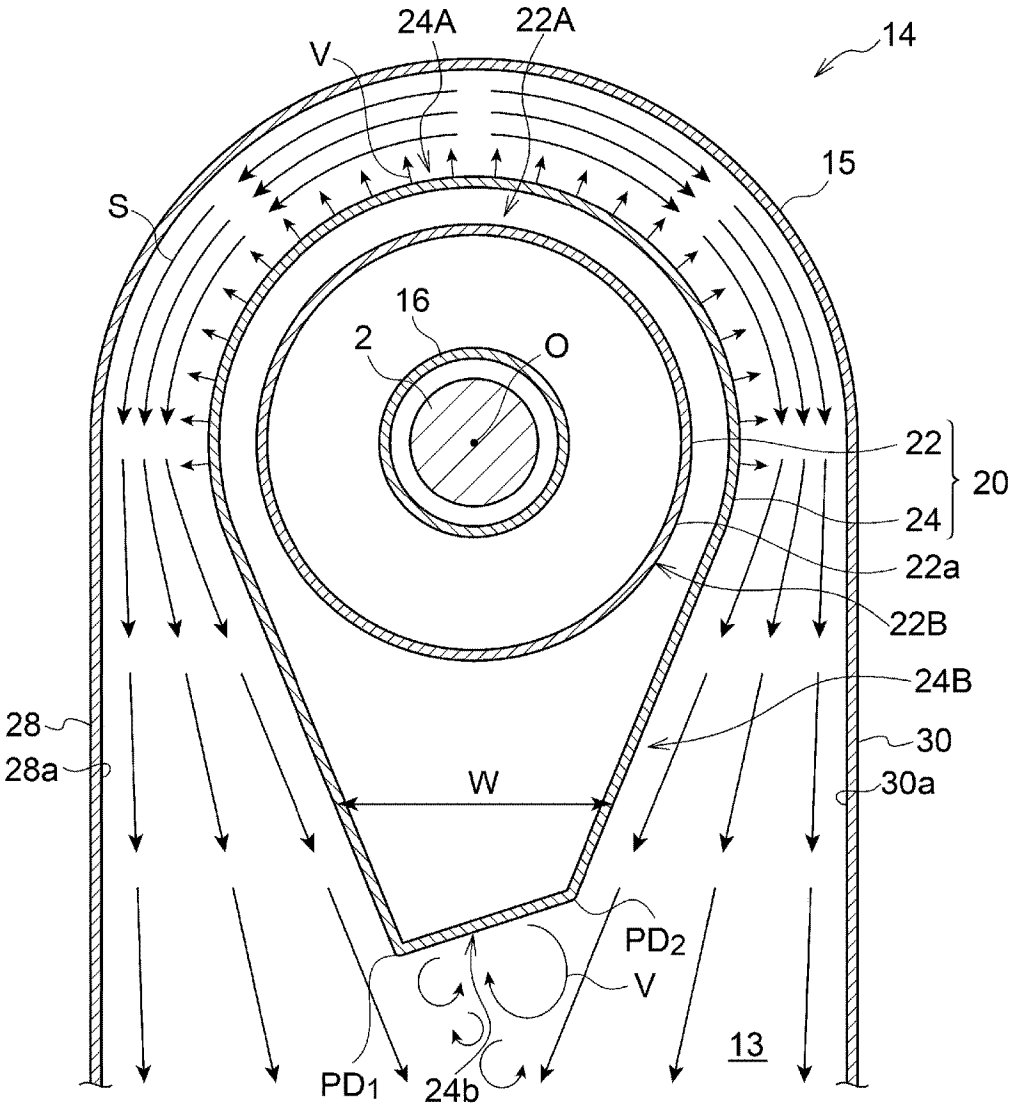
FIG. 7B is a cross-sectional view taken along line B-B of FIG. 7A.
Figure 7A:
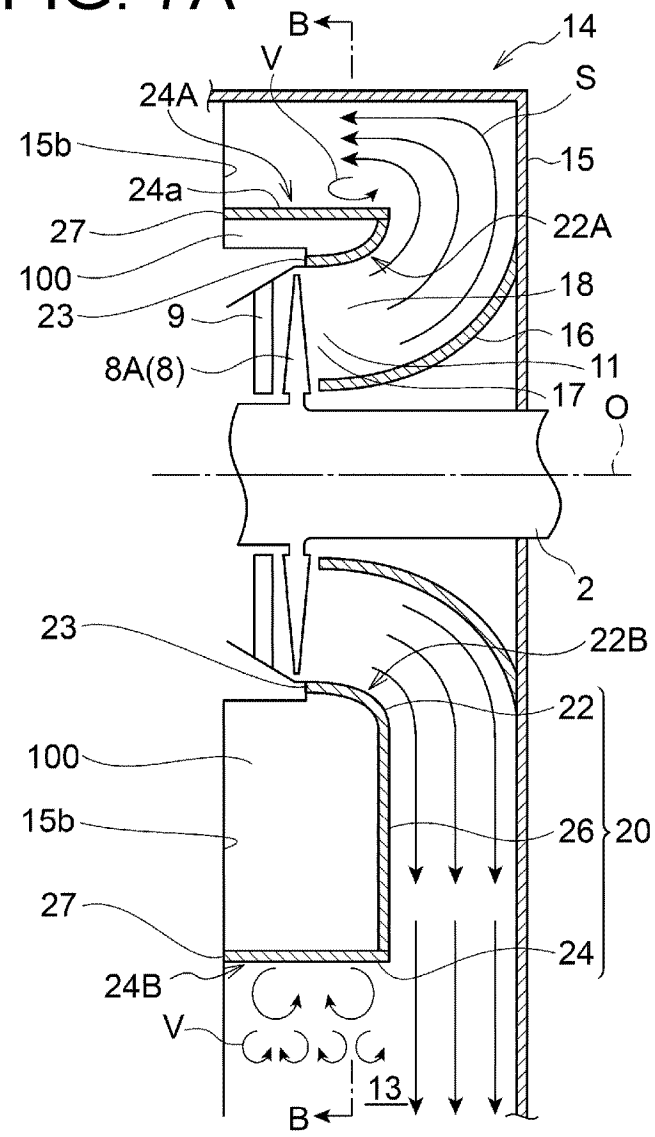
FIG. 7A is a cross-sectional view of the inner flow guide portion of the exhaust chamber according to an embodiment, taken along the axial direction.
Figure 8B:
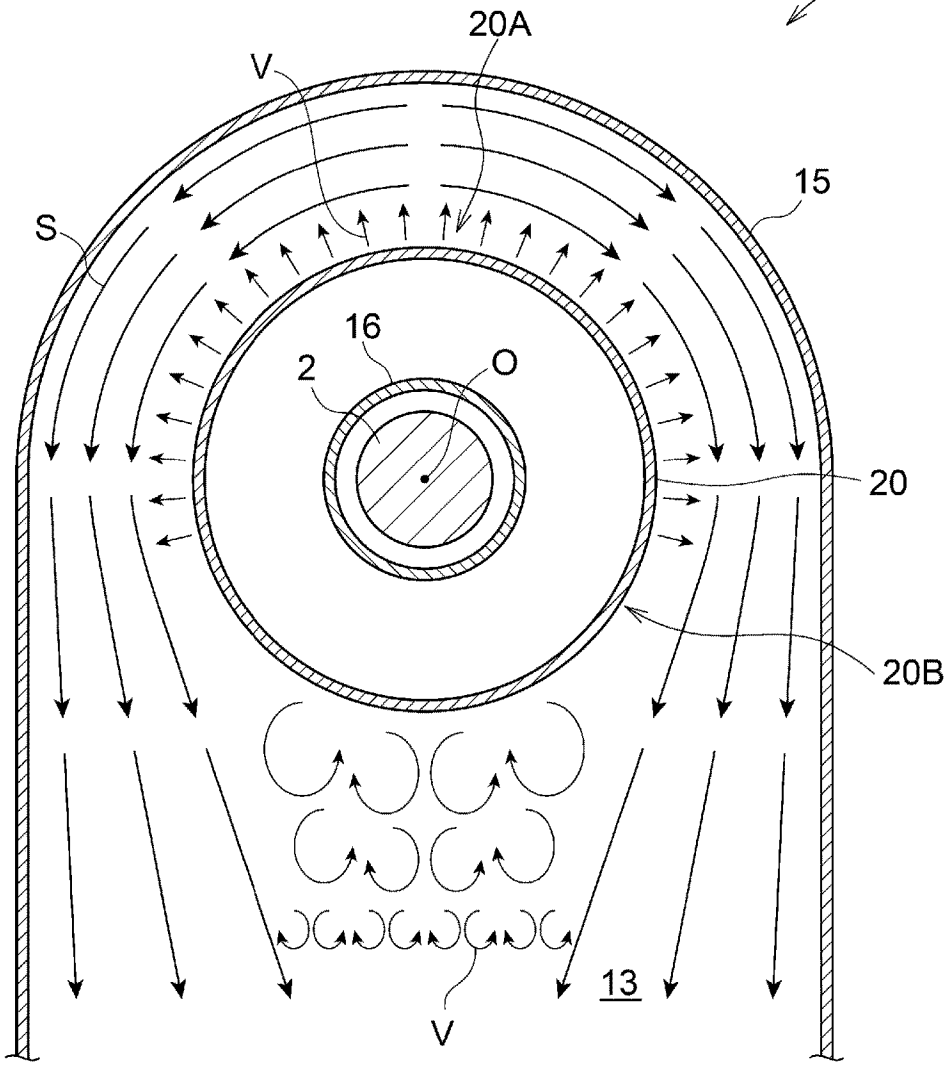
FIG. 8B is a cross-sectional view taken along line B-B of FIG. 8A.
Figure 8A:
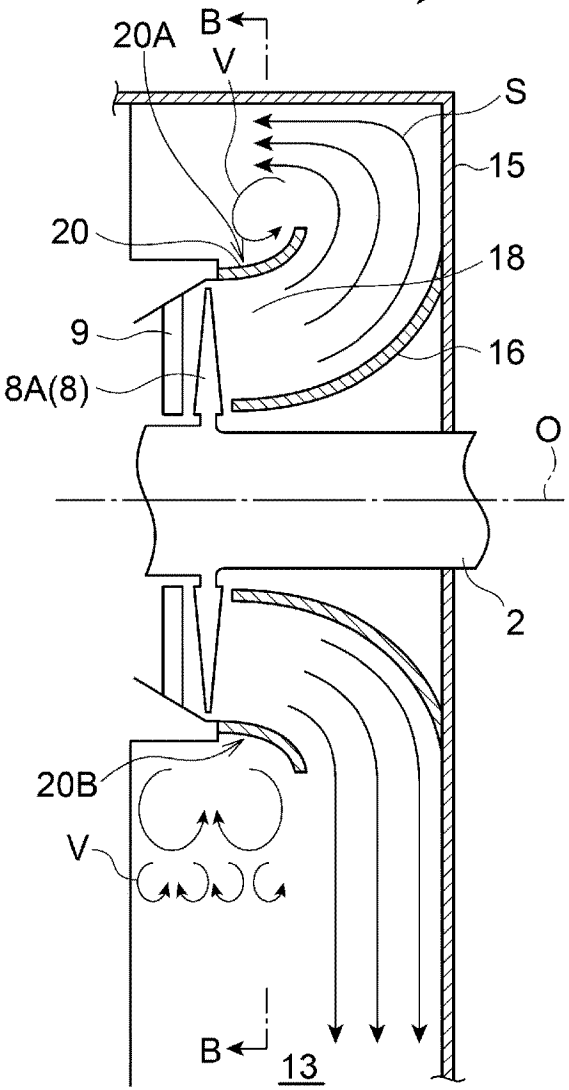
FIG. 8A is a cross-sectional view of a flow guide of the typical exhaust chamber, taken along an axial direction.

FIGS. 8A and 8B are each an example of a schematic cross-sectional view of the typical exhaust chamber. FIG. 8A is the cross-sectional view of the flow guide of the typical exhaust chamber, taken along an axial direction. FIG. 8B is the cross-sectional view taken along line B-B of FIG. 8A. In FIGS. 8A and 8B, members having the same reference numerals as those in the embodiments shown in FIGS. 2A to 7B are not described repeatedly.

The flow guide 20 disposed in the typical exhaust chamber 14 shown in FIGS. 8A and 8B includes a portion corresponding to the inner flow guide portion 22 in the embodiments shown in FIGS. 2A to 7B, but does not include a portion corresponding to the outer flow guide portion 24.

In an upper half region of such a typical exhaust chamber 14, for example, as shown in FIGS. 8A and 8B, the steam flows S passing through the diffuser passage 18 may circulate back (an opposite side to the diffuser passage 18 across the flow guide 20) into an upper half region 20A of the flow guide 20 (the portion corresponding to the inner flow guide portion 22 shown in FIGS. 2A to 7B) forming the diffuser passage 18 and form a separation vortex V.

In this regard, in the embodiments shown in FIGS. 2A to 7B, the outer flow guide portion 24 (including the upper half region 24A of the outer flow guide portion 24) disposed at least around the upper half region 22A of the inner flow guide portion 22 can guide the steam flows S which are guided to the inner flow guide portion 22 to flow through the diffuser passage 18 and tend to circulate back into the upper half region 22A of the inner flow guide portion 22. Thus, in the embodiments shown in FIGS. 2A to 7B, compared to the example shown in FIGS. 8A and 8B, it is possible to further reduce the separation vortices V which are generated by the steam flows S tending to circulate back into the upper half region 22A of the inner flow guide portion 22. For example, FIGS. 2A and 2B, 3A and 3B, 6A and 6B, and 7A and 7B show that the separation vortices become smaller in size or number in an upper half region of the exhaust chamber 14 than in the typical example shown in FIGS. 8A and 8B. Thus, it is possible to reduce a fluid loss in the exhaust chamber 14 and to improve efficiency in the steam turbine 1 as a whole.

In some embodiments, at least a part of a connection portion 25 between the outer flow guide portion 24 and the upper half region 22A of the inner flow guide portion 22 has a curved shape in a cross section along the axial direction of the inner flow guide portion. In the embodiment shown in FIGS. 3A and 3B, as shown in FIG. 3A, the upper half region 22A of the inner flow guide portion 22 and the outer flow guide portion 24 are smoothly connected via the connection portion 25 having the curved shape.

In some embodiments, the inner flow guide portion 22 may be a portion of the flow guide 20, a diameter of which gradually increases in the axial direction toward a wall surface of the casing 15 from the exhaust chamber inlet 11.

As described above, since the upper half region 22A of the inner flow guide portion 22 and the outer flow guide portion 24 are connected via the connection portion 25 having the curved shape, the steam flows S tending to circulate back into the upper half region 22A of the inner flow guide portion 22 flow to the outer flow guide portion 24 via the connection portion 25 having the curved shape. Thus, it is possible to reduce the separation vortices V of the steam flows S even further and to reduce the fluid loss in the exhaust chamber 14 more effectively.

In some embodiments, as shown in FIGS. 2A to 7B, the outer flow guide portion 24 is disposed on the outer peripheral side of the inner flow guide portion 22 over an entire periphery of the inner flow guide portion 22. That is, in the embodiments shown in FIGS. 2A to 7B, the upper half region 24A of the outer flow guide portion 24 is disposed around the upper half region 22A of the inner flow guide portion 22, and the lower half region 24B of the outer flow guide portion 24 is disposed around the lower half region 22B of the inner flow guide portion 22.

The lower half region 24B of the outer flow guide portion 24 may have such a shape that a width W of the outer flow guide portion 24 in a horizontal direction decreases downward in the cross section (each of FIGS. 2B, 3B, 4, 5, 6B, and 7B) orthogonal to the center axis O of the inner flow guide portion 22.

For example, as shown in FIGS. 8A and 8B, in the typical exhaust chamber 14 without the portion corresponding to the outer flow guide portion 24, the separation vortices V of the steam flows S may be formed not only in the upper half region but also in the lower half region. That is, the steam flows S passing through the diffuser passage 18 may circulate back (the opposite side to the diffuser passage 18 across the flow guide 20) into a lower half region 20B of the flow guide 20 (a portion corresponding to the inner flow guide portion 22 shown in FIGS. 2A to 7B) forming the diffuser passage 18 and form the separation vortex V.

In addition, even if the upper half region 24A of the outer flow guide portion 24 is disposed only in the upper half region, steam flows directed downward along the outer flow guide portion 24 after passing through the diffuser passage 18 and circulating back into the upper half region 22A of the inner flow guide portion 22 may circulate back into the lower half region 20B of the inner flow guide portion 22 and form the separation vortex V.

In this regard, in the embodiments shown in FIGS. 2A to 7B, the outer flow guide portion 24 disposed over the entire periphery of the inner flow guide portion 22 can suppress even the separation vortices V (the separation vortices V in the lower half region) of the steam flows S directed downward along the outer flow guide portion 24 after passing through the diffuser passage 18 and circulating back into the upper half region 22A of the inner flow guide portion 22.

In the embodiments shown in FIGS. 2A to 7B, a radial distance D between a first intersection point $P_1$ of the inner flow guide portion 22 with a line segment S extending radially from the center axis O of the inner flow guide portion 22 and a second intersection point $P_2$ of the outer flow guide portion with the line segment S becomes a maximum value $D_{max}$ at an angular position around the center axis O which is included in an angular range on a lower side of a horizontal plane H including the center axis O.

For example, in the embodiment shown in FIGS. 2A and 2B, at a position where the angular position around the center axis O is a vertically downward position from the center axis O, a distance between a first intersection point $P_{1d}$ and a second intersection point $P_{2d}$ where a segment $S_d$ extending radially (vertically downward) from the center axis O respectively intersect with the inner flow guide portion 22 and the outer flow guide portion 24 becomes the maximum value $D_{max}$. That is, the vertically downward position which is the angular position around the center axis O where the above-described distance D becomes the maximum value $D_{max}$ is included in the angular range on the lower side of the horizontal plane H including the center axis O.

Since the exhaust chamber 14 has the exhaust chamber outlet 13 on the lower side, flows directed downward as a whole are mainly formed in the exhaust chamber 14. In this regard, as the embodiments shown in FIGS. 2A to 7B, the distance D between the inner flow guide portion 22 and the outer flow guide portion 24 (the distance D between the first intersection point $P_1$ and the second intersection point $P_2$) becomes the maximum value $D_{max}$ in the lower half region, making it possible to effectively suppress the separation vortices V in correspondence with the downward flows in the exhaust chamber 14.

If the outer flow guide portion 24 is not disposed below, for example, as shown in FIGS. 8A and 8B, below the flow guide 20 corresponding to the inner flow guide portion 22, separation is likely to occur in a broad area. Thus, the outer flow guide portion 24 has a shape extending downward, and then it is possible to flow the steam flows S directed downward on the side along the outer flow guide portion 24, making it possible to suppress separation.

In some embodiments, the angular position at which the above-described distance becomes the maximum value $D_{max}$ is located at a downstream side in a swirl direction of the steam flows S in the exhaust chamber inlet 11 of the exhaust chamber 14 compared to an angular position extending vertically downward through the center axis O.

For example, in the embodiment shown in FIG. 4, the angular position (indicated by a segment $S_1$ in FIG. 4) at which the above-described distance D becomes the maximum value $D_{max}$ is located at the downstream side in the swirl direction of the steam flows S (anticlockwise direction in FIG. 4) by an angle $\theta_1$ compared to the angular position extending vertically downward (indicated by a segment $S_d$ in FIG. 4) through the center axis O.

A flow in the exhaust chamber 14 is influenced by a rotation of the rotor 2, and thus may include a swirl component. In this case, flow deflection owing to the swirl component occurs in the exhaust chamber 14.

In this regard, for example, as the embodiment shown in FIG. 4, an angular position at which an interval between the inner flow guide portion 22 and the outer flow guide portion 24 (the above-described distance D between the first intersection point $P_1$ and the second intersection point $P_2$) becomes maximum is displaced to the downstream side in the swirl direction, giving the outer flow guide portion 24 a shape considering the flow deflection and making it possible to reduce a pressure loss in the exhaust chamber 14.

In some embodiments, as shown in FIGS. 2A, 3A, 6A, and 7A, in addition to the inner flow guide portion 22 and the outer flow guide portion 24, the flow guide 20 further includes an intermediate flow guide portion 26 which connects the lower half region 22B of the inner flow guide portion 22 and the lower half region 24B of the outer flow guide portion 24.

As shown in the drawings, the intermediate flow guide portion 26 is disposed below the inner flow guide portion 22 so as to suspend from the lower half region 22B of the inner flow guide portion 22 toward the lower half region 24B of the outer flow guide portion 24.

The intermediate flow guide portion 26 which connects the lower half region 22B of the inner flow guide portion 22 and the lower half region 24B of the outer flow guide portion 24 appropriately guides downward flows flowing out of the lower half region 22B of the inner flow guide portion 22. It is possible to effectively suppress the separation vortices V below the inner flow guide portion 22.

Figure 3B:
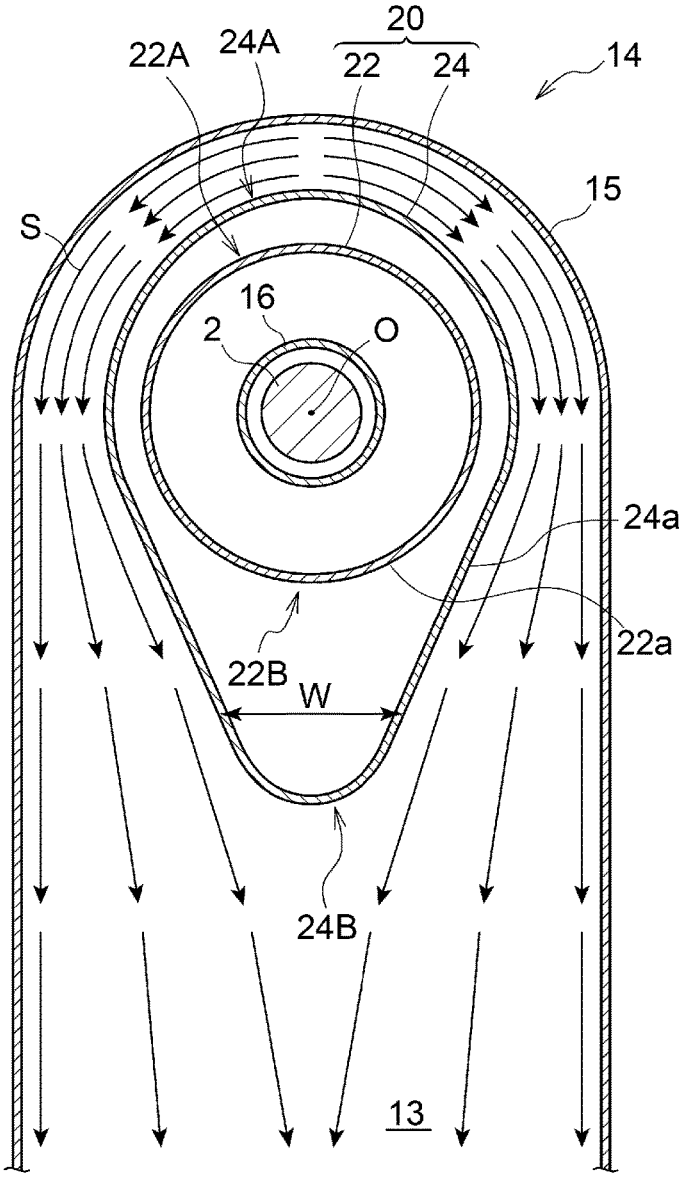
FIG. 3B is a cross-sectional view taken along line B-B of FIG. 3A.

In the exemplary embodiment shown in FIGS. 3A and 3B, the intermediate flow guide portion 26 is oblique with respect to a vertical direction to be directed to an upstream side of the steam flows S in the diffuser passage 18 toward downward in a cross section along the axial direction.

The upstream side of the steam flows S in the diffuser passage 18 means an upstream side in a flow direction of the steam flows S flowing into the exhaust chamber 14 from the exhaust chamber inlet 11.

In this case, a cross-sectional area of the steam flow passage formed by the intermediate flow guide portion 26 and the inner wall surface of the casing 15 is gradually expanded downward, promoting static pressure recovery in the exhaust chamber 14. Thus, it is possible to reduce a loss in the exhaust chamber 14 more effectively.

In some embodiments, for example, as shown in FIG. 5, the upper half region 24A of the outer flow guide portion 24 is displaced from the center axis O of the inner flow guide portion 22 such that a distance between an inner wall surface 15*a* of the casing 15 and the upper half region 24A of the outer flow guide portion 24 on a downstream side in the swirl direction of the steam flows S in the exhaust chamber inlet 11 of the exhaust chamber 14 is larger than the distance between the inner wall surface 15*a* of the casing 15 and the upper half region 24A of the outer flow guide portion 24 on an upstream side in the swirl direction.

In the cross-sectional view shown in FIG. 5, a line $L_2$ extending in a perpendicular direction through a center C of the outer flow guide portion 24 deviates to the upstream side in the swirl direction in the upper half region by a distance $G_{off}$ from a line L1 extending in the perpendicular direction through the center axis O of the inner flow guide portion 22.

That is, in the exemplary embodiment shown in FIG. 5, the upper half region 24A of the outer flow guide portion 24 is displaced by the distance $G_{off}$ from the center axis O of the inner flow guide portion 22. In the upper half region, a distance $K_2$ between the inner wall surface 15*a* of the casing 15 and the upper half region 24A of the outer flow guide portion 24 on the downstream side in the swirl direction of the steam flows S is larger than a distance $K_1$ between the inner wall surface 15*a* of the casing 15 and the upper half region 24A of the outer flow guide portion 24 on the upstream side in the swirl direction.

In the exhaust chamber 14, the steam flows S tend to deflect on the downstream side in the swirl direction in the upper half region.

In this regard, as the embodiment shown in FIG. 5, it is possible to reduce a pressure loss of a fluid in the exhaust chamber 14 by displacing the upper half region 24A of the outer flow guide portion 24 from the center axis O of the inner flow guide portion 22 such that a flow passage cross-sectional area on the downstream side in the swirl direction of the steam flows S increases in the upper half region of the exhaust chamber 14.

Figure 6B:
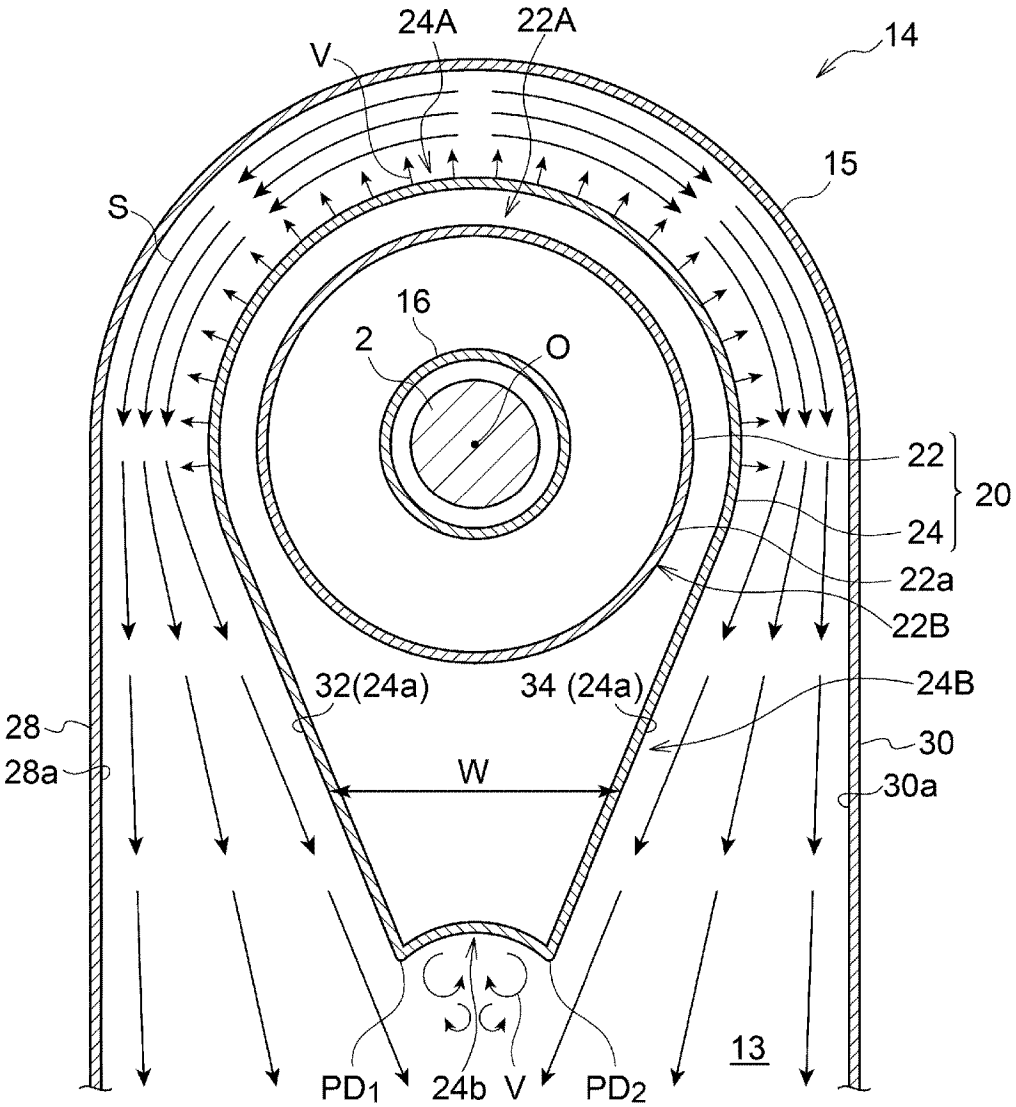
FIG. 6B is a cross-sectional view taken along line B-B of FIG. 6A.
Figure 6A:
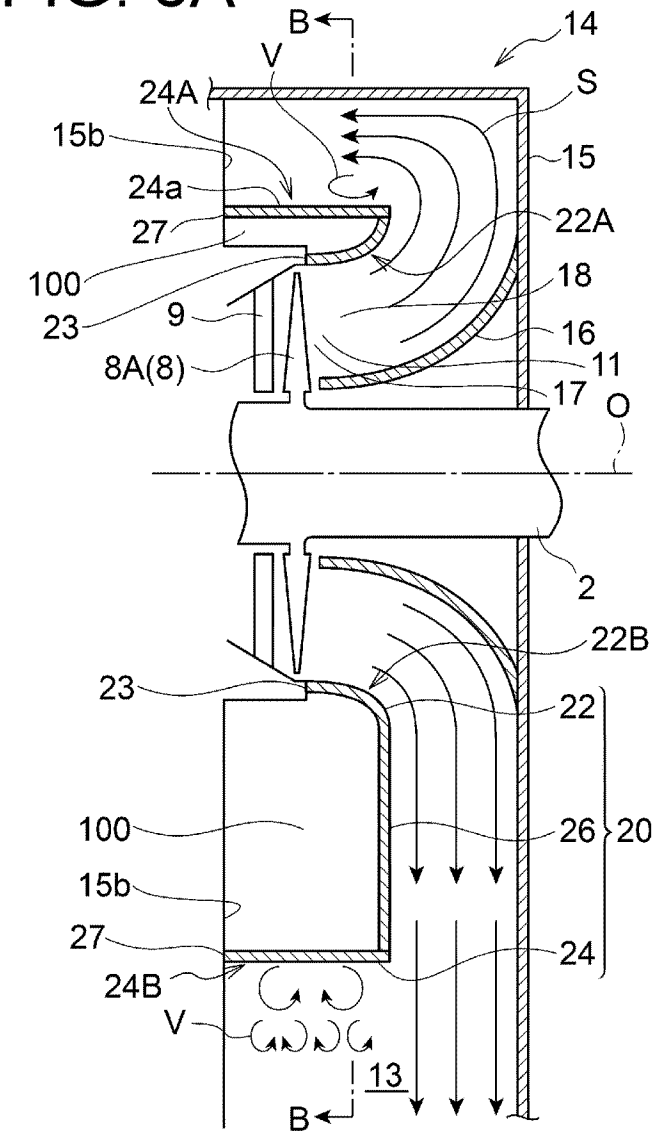
FIG. 6A is a cross-sectional view of the inner flow guide portion of the exhaust chamber according to an embodiment, taken along the axial direction.

In the embodiments shown in FIGS. 6A and 6B, and 7A and 7B, a lower end part 24*b* of the outer flow guide portion 24 includes a first discontinuous point $PD_1$ and a second discontinuous point $PD_2$ in a cross section along an orthogonal plane of the center axis O of the inner flow guide portion 22 (see FIGS. 6B and 7B). The first discontinuous point $PD_1$ is on a first surface 32 of the outer flow guide portion 24 facing an inner surface 28*a* of a first side wall 28 of the casing 15. The second discontinuous point $PD_2$ is on a second surface 34 of the outer flow guide portion 24 facing an inner surface 30*a* of a second side wall 30 of the casing 15 on an opposite side to the first side wall 28.

In the embodiments shown in FIGS. 6A and 6B, and 7A and 7B, at each of the first discontinuous point $PD_1$ and the second discontinuous point $PD_2$ of the lower end part 24*b* of the outer flow guide portion 24, flows guided by the outer flow guide portion 24 toward downward easily separate from each other. Therefore, flow separation positions in the lower end part 24*b* of the outer flow guide portion 24 are fixed (stabilized), making it possible to reduce an unsteady loss.

In some embodiments, as the embodiment shown in FIGS. 7A and 7B, the first discontinuous point $PD_1$ and the second discontinuous point $PD_2$ may have different height positions from one another.

As described above, by disposing the first discontinuous point $PD_1$ and the second discontinuous point $PD_2$ at the different height positions, the flow separation positions in the lower end part 24*b* of the outer flow guide portion 24 become asymmetric, making it possible to suppress occurrence of an unsteady vortex. Therefore, it is possible to reduce the unsteady loss more effectively.

Embodiments of the present invention were described in detail above, but the present invention is not limited thereto, and various amendments and modifications may be implemented.

For example, in the exemplary embodiments shown in FIGS. 2A, 3A, 6A, and 7A, in the cross section along the axial direction, an end part 27 of the outer flow guide portion 24 is connected to an inner wall surface 15*b* of the casing 15, making the diffuser passage 18 independent of a space 100 between the outer flow guide portion 24 and the inner flow guide portion 22. That is, the diffuser passage 18 is closed by the outer flow guide portion 24 and the inner wall surface 15*b* of the casing 15, and is in a non-communicating state with the space 100 between the outer flow guide portion 24 and the inner flow guide portion 22. In this case, it is possible to achieve an improved effect of suppressing the separation vortices V by the outer flow guide portion 24.

In other embodiments, however, in at least a partial range in a circumferential direction, the end part 27 of the outer flow guide portion 24 may be spaced apart from the inner wall surface 15*b* of the casing 15. In this case, the end part 27 of the outer flow guide portion 24 may be positioned on an upstream side in a flow direction of the steam flows S flowing into the exhaust chamber 14 via the exhaust chamber inlet 11 with respect to an end part 23 of the inner flow guide portion 22 (that is, the end part 27 may be formed such that the length of the outer flow guide portion 24 in the axial direction is larger than the length of the inner flow guide portion 22 in the axial direction). Thus, it is possible to increase the effect of suppressing the separation vortices V by the outer flow guide portion 24.

The inner wall surface 15*b* of the casing 15 is a surface of the casing 15 which is positioned on the upstream side in the flow direction of the steam flows S flowing into the exhaust chamber 14 via the exhaust chamber inlet 11 of the inner wall surface of the casing 15 substantially orthogonal to the center axis O of the inner flow guide portion 22. The inner wall surface 15*b* of the casing 15 may be disposed only in a partial circumferential range (for example, only in the lower half region).

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include" and "have" are not intended to be exclusive of other components.

REFERENCE SIGNS LIST

1 Steam turbine
2 Rotor
3 Steam inlet
6 Bearing portion
6 Rotor blade
8A Last stage rotor blade
9 Stator vane
10 Inner casing
11 Exhaust chamber inlet
12 Outer casing
13 Exhaust chamber outlet
14 Exhaust chamber
15 Casing
15*a* Inner wall surface
16 Bearing cone
17 Last stage blade outlet
18 Diffuser passage
20 Flow guide
20A Upper half region
20B Lower half region
22 Inner flow guide portion
22A Upper half region
22B Lower half region
22*a* Inner surface
24 Outer flow guide portion
24A Upper half region
24B Lower half region

24*a* Outer surface
24*b* Lower end part
25 Connection portion
26 Intermediate flow guide portion
28 First side wall
28*a* Inner surface
28 Second side wall
30*a* Inner surface
30 First surface
34 Second surface
O Center axis

The invention claimed is:

1. An exhaust chamber of a steam turbine, comprising:
a casing;
an inner flow guide portion disposed in the casing so as to define an outer boundary of a diffuser passage communicating with an outlet of a last stage blade in the steam turbine; and
an outer flow guide portion disposed on an outer peripheral side of the inner flow guide portion in the casing,
wherein the exhaust chamber has an exhaust chamber outlet on a lower side thereof,
wherein the outer flow guide portion is disposed on the outer peripheral side of the inner flow guide portion over an entire periphery of the inner flow guide portion, and
wherein an upper half region of the outer flow guide portion is displaced from a center axis of the inner flow guide portion such that a distance between an inner wall surface of the casing and the upper half region of the outer flow guide portion on a downstream side in a swirl direction of a steam flow in an exhaust chamber inlet of the exhaust chamber is larger than the distance between the inner wall surface of the casing and the upper half region of the outer flow guide portion on an upstream side in the swirl direction.

2. The exhaust chamber of the steam turbine according to claim 1,
wherein at least a part of a connection portion between the outer flow guide portion and an upper half region of the inner flow guide portion has a curved shape in a cross section along an axial direction of the inner flow guide portion.

3. The exhaust chamber of the steam turbine according to claim 1,
wherein an angular position around a center axis of the inner flow guide portion at which a radial distance between a first intersection point of the inner flow guide portion with a line segment extending radially from the center axis and a second intersection point of the outer flow guide portion with the line segment becomes maximum is included in an angular range on a lower side of a horizontal plane including the center axis.

4. The exhaust chamber of the steam turbine according to claim 3,
wherein the angular position at which the radial distance becomes maximum is located at a downstream side in a swirl direction of a steam flow in an exhaust chamber inlet of the exhaust chamber compared to an angular position extending vertically downward through the center axis.

5. The exhaust chamber of the steam turbine according to claim 1, further comprising an intermediate flow guide portion disposed below the inner flow guide portion so as to suspend from a lower half region of the inner flow guide portion toward a lower half region of the outer flow guide portion, and the intermediate flow guide portion connects the lower half region of the inner flow guide portion and the lower half region of the outer flow guide portion.

6. The exhaust chamber of the steam turbine according to claim 5,
wherein the intermediate flow guide portion is oblique with respect to a vertical direction to be directed to an upstream side of a steam flow in the diffuser passage toward downward in a cross section along an axial direction of the inner flow guide portion.

7. The exhaust chamber of the steam turbine according to claim 1,
wherein, in a cross section along an orthogonal plane of a center axis of the inner flow guide portion, a lower end part of the outer flow guide portion includes:
a first discontinuous point on a first surface of the outer flow guide portion facing an inner surface of a first side wall of the casing; and
a second discontinuous point on a second surface of the outer flow guide portion facing an inner surface of a second side wall of the casing on an opposite side to the first side wall.

8. The exhaust chamber of the steam turbine according to claim 7,
wherein the first discontinuous point and the second discontinuous point have different height positions from one another.

9. A steam turbine comprising:
the exhaust chamber according to claim 1;
a rotor blade disposed on an upstream side of the exhaust chamber; and
a stator vane disposed on the upstream side of the exhaust chamber.

10. An exhaust chamber of a steam turbine, comprising:
a casing;
an inner flow guide portion disposed in the casing so as to define an outer boundary of a diffuser passage communicating with an outlet of a last stage blade in the steam turbine; and
an outer flow guide portion disposed on an outer peripheral side of the inner flow guide portion in the casing,
wherein the exhaust chamber has an exhaust chamber outlet on a lower side thereof,
wherein the outer flow guide portion is disposed on the outer peripheral side of the inner flow guide portion over an entire periphery of the inner flow guide portion,
wherein an angular position around a center axis of the inner flow guide portion at which a radial distance between a first intersection point of the inner flow guide portion with a line segment extending radially from the center axis and a second intersection point of the outer flow guide portion with the line segment becomes maximum is included in an angular range on a lower side of a horizontal plane including the center axis, and
wherein the angular position at which the radial distance becomes maximum is located at a downstream side in a swirl direction of a steam flow in an exhaust chamber inlet of the exhaust chamber compared to an angular position extending vertically downward through the center axis.

11. A steam turbine comprising:
the exhaust chamber according to claim 10;
a rotor blade disposed on an upstream side of the exhaust chamber; and
a stator vane disposed on the upstream side of the exhaust chamber.

12. A steam turbine comprising:
the exhaust chamber according to claim 10;

a rotor blade disposed on an upstream side of the exhaust chamber; and a stator vane disposed on the upstream side of the exhaust chamber.

13. An exhaust chamber of a steam turbine, comprising:

a casing;

an inner flow guide portion disposed in the casing so as to define an outer boundary of a diffuser passage communicating with an outlet of a last stage blade in the steam turbine; and an outer flow guide portion disposed on an outer peripheral side of the inner flow guide portion in the casing, wherein the exhaust chamber has an exhaust chamber outlet on a lower side thereof, wherein the outer flow guide portion is disposed on the outer peripheral side of the inner flow guide portion over an entire periphery of the inner flow guide portion, and wherein, in a cross section along an orthogonal plane of a center axis of the inner flow guide portion, a lower end part of the outer flow guide portion includes:

a first discontinuous point on a first surface of the outer flow guide portion facing an inner surface of a first side wall of the casing; and a second discontinuous point on a second surface of the outer flow guide portion facing an inner surface of a second side wall of the casing on an opposite side to the first side wall.

14. The exhaust chamber of the steam turbine according to claim 13, wherein the first discontinuous point and the second discontinuous point have different height positions from one another.

* * * * *